United States Patent [19]

Hatton

[11] 4,354,310

[45] Oct. 19, 1982

[54] METHOD OF MAKING INDUCTANCE

[76] Inventor: Richard L. Hatton, 558 Eton Dr., Barrington, Ill. 60010

[21] Appl. No.: 149,315

[22] Filed: May 13, 1980

Related U.S. Application Data

[63] Continuation-in-part of Ser. No. 22,808, Mar. 22, 1979, abandoned.

[51] Int. Cl.[3] ..... H01F 41/06; H01R 43/00

[52] U.S. Cl. ..... 29/605; 29/844; 29/882; 336/192

[58] Field of Search ..... 29/602 R, 605, 842, 29/844, 845, 882, 884, 747, 741, 564.6; 336/192, 208; 339/220 C, 220 T, 220 R

[56] References Cited

U.S. PATENT DOCUMENTS

| | | | |
|---|---|---|---|
| 984,097 | 2/1911 | Lundgren | 336/192 X |
| 2,533,987 | 12/1950 | Bahr | 339/220 T |
| 2,892,177 | 6/1959 | Scherry | 339/220 C |
| 3,731,261 | 5/1973 | Spadoni, Jr. | 339/220 R |
| 3,947,958 | 4/1976 | Bowers | 29/564.6 X |
| 3,948,013 | 4/1976 | Lobaugh et al. | 29/509 X |

*Primary Examiner*—Carl E. Hall

*Attorney, Agent, or Firm*—Tilton, Fallon, Lungmus & Chestnut

[57] ABSTRACT

A method for making an inductance which includes the steps of providing a coil form constructed of insulating material and having at least one opening extending there through for the receipt of a wire terminal, supporting a wire terminal in a cut-off mechanism positioning the so-supported wire terminal in the coil form opening, immobilizing the wire terminal by notching, removing the cut-off wire terminal from the cut-off mechanism winding a wire about the coil form and wrapping one end of the wire around one of the terminals, and dipping the wrapped terminal portion in molten solder.

6 Claims, 9 Drawing Figures

METHOD OF MAKING INDUCTANCE

This application is a continuation-in-part of my copending application Ser. No. 22,808 filed Mar. 22, 1979 now abandoned.

BACKGROUND AND SUMMARY OF INVENTION

This invention relates to a method for making an inductance from a coil form constructed of insulating material and, more particularly, to immobilizing a wire lead in at least one opening extending through the coil form.

In past inductance fabrications, lead wires have been positioned in the openings of plastic coil forms for use as a conduit between the wire windings of the electrical inductance and other electrical components. Normally the end portion of the wire winding is soldered to a positioned lead wire or terminal. This soldering process increases the temperature of the wire terminal and subsequently may melt and/or deteriorate the confronting plastic surface of the coil form about the wire terminal. The resulting product contains a terminal which is loosely secured to an opening of the plastic coil form and easily susceptible to shift or even loss so as to change or seriously impair the inductive value. Even assuming that the loosening is only minimal, the wire terminal may still be susceptible to falling out of the opening if more than three pounds of pressure is applied to it. The pressure limit is often surpassed when the ends of the terminals are pushed into a printed circuit board. Thus, the weak terminal connection creates a slow down in the circuit board assembly and may even cause defective circuit boards to be produced.

The invention provides a method for making an inductance whereby a supported or stabilized wire terminal is notched adjacent each surface of the coil form through which it is inserted and prior to connecting and soldering a wound wire to the wire terminal. The general idea of notching or staking a wire is known from U.S. Pat. No. 3,731,261, for example. In other words, the idea of creating an interference dimension on either side of the coil form base is established technology. However, even with that state of the art, there is no guarantee that the wire terminal will be precisely positioned in the predetermined location. Overcoming this defect is a principal object of this invention.

The invention more particularly provides a method wherein the wire intended to be the terminal is first supported or stabilized within a cut-off mechanism so that the wire length is rigidified prior and during the notching or staking operation. The resulting coil form has a rugged, sturdy wire terminal connection capable of withstanding up to about 10 pounds of force.

DETAILED DESCRIPTION

The invention is explained in conjunction with the accompanying drawing in which.

Figure 1:
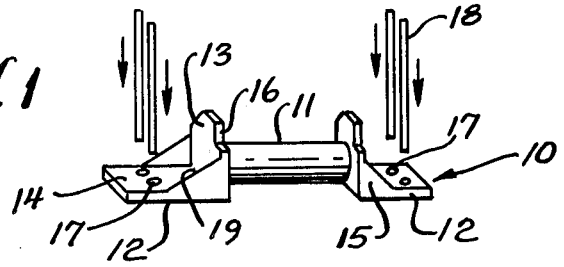
FIG. 1 is an exploded perspective view of a plastic coil form equipped with openings to receive wire terminals and with the wire terminals shown in spaced relationship thereto.
Figure 2:
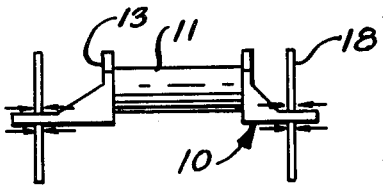
FIG. 2 is a side view of the coil form illustrating schematically the steps of positioning and immobilizing the wire terminals—with arrows indicating the notched areas on the front two terminals.
Figure 3:
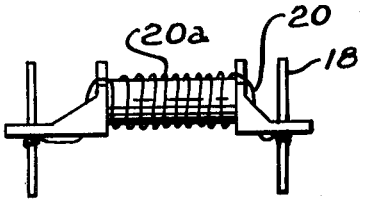
FIG. 3 is a side view of the coil form illustrating the step of winding wire about the coil form to form a coil.
Figure 4:
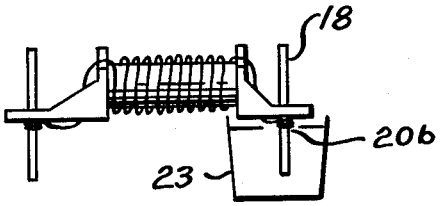
FIG. 4 is a side view of the coil form illustrating the step of dipping the wrapped wire terminal in a solder pot.

Referring to FIGS. 1 and 2, the numeral 10 designates generally an elongated coil form constructed of insulating material such as a thermoplastic material as nylon or a thermo-setting material as diallyl phthalate. The middle portion 11 of the form 10 is tubular or cylindrical and has a generally circular transverse cross section. Each end section 12 is integral therewith and is L-shaped—having a vertical flange 13 abutting one end of the tubular portion 11 and a horizontal flange 14 extending horizontally outwardly from the vertical surface 13. Slanted gussets 15 are positioned on each side of end sections 12 and connected to both vertical flanges 13 and horizontal flanges 14. A notch or recess 16 is defined in one side of vertical flange 13 so as to accommodate and position a portion of the wire winding as seen in FIGS. 3 and 4.

Opening or passage 17 extends through horizontal flanges 14 for the receipt of wire terminals 18. In the illustrated embodiment in FIG. 1, two openings 17 are provided in each horizontal flange 14. It is understood that one or more openings 17 may extend through each horizontal flange for the receipt of wire terminals 18. Also, horizontal flanges 14 each have a vertical bore 19 for the passage of the lead wire 20 (see FIG. 3).

As illustrated schematically in FIG. 2, wire leads 18 are vertically positioned in opening 17 after the coil form has been constructed. A wire terminal 18 is inserted into opening 17 and flange 14 so that it extends away from flange 14 both upwardly and downwardly, i.e., having two end portions extending away from the flange 14. In this condition, the wire terminal 18 is suitably notched to develop the configuration seen in larger scale in FIGS. 5 and 6. For this purpose, a jaw-like mechanism is employed which operates only on opposite sides of the wire terminal and not entirely circumferentially thereabout. This preserves the stability and integrity of the wire terminals against possible breakage upon the imposition of bending forces.

Figure 5:
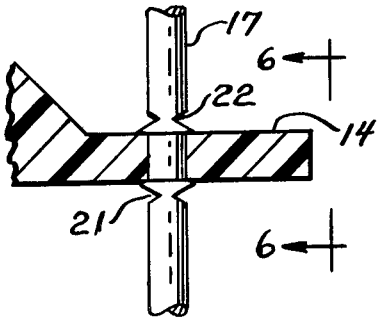
FIG. 5 is an enlarged axial sectional view of the coil form about a notched wire terminal positioned in an opening.
Figure 6:
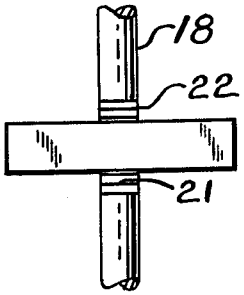
FIG. 6 is an end view of the portion of the structure seen in FIG. 5.

The arrows in FIG. 2 indicate where the notching occurs on the wire terminals 18. FIG. 5 illustrates the shape of the wire terminal after notching as at 21 and 22—this from the axial sectional view while FIG. 6 illustrates the same condition from the end view.

In the next step as illustrated in FIG. 3, a wire **20*a* is wound about portion 11 of coil form 10 and thereafter passed through an opening 19 in flange 14 for winding about an end of the wire terminal 18**. It will be appreciated that a particular winding may have its ends wound on leads at the same or opposite ends of the coil form, depending on whether the product desired is a plain coil or whether it is a transformer.

FIG. 4 illustrates the final step of dipping the wrapped lower terminal **20*b*** into a pot of molten solder 23 to fix the wire end portion 20*b* to the lower portion of the wire terminal 18. This step may be similarly repeated or simultaneously performed for the other end of the coil form.

Figure 7:
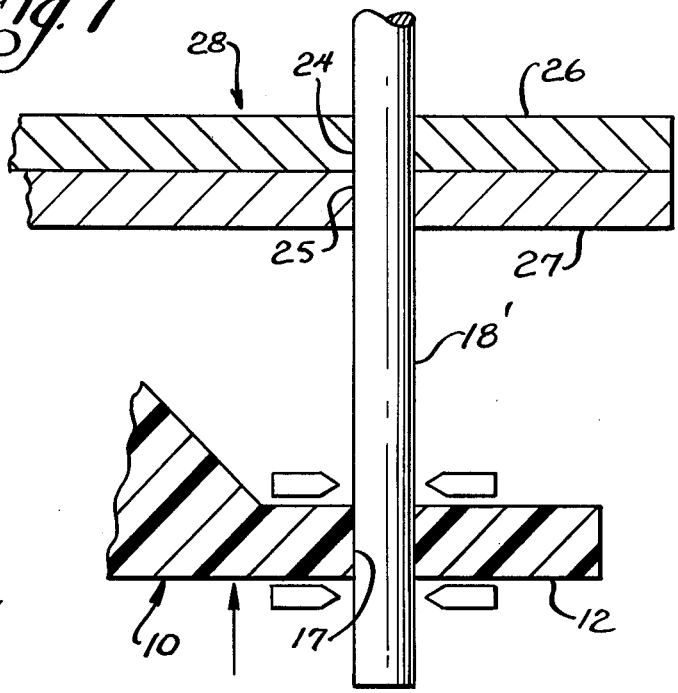
FIG. 7 is a fragmentary elevational view partially in section of apparatus employed in the practice of the invention.

Turning now to the second sheet of the drawing, the operation previously depicted relative to FIG. 1 is shown in larger scale and detail. In FIG. 7, for example, the flange 12 of the coil form 10 is seen to be in the process of being ensleeved about a continuous wire 18′, i.e., the opening 17 receives the wire 18′. The continuous wire 18′ is developed from a reel (not shown) and is passed through aligned openings 24 and 25 of plates 26 and 27 of a cut-off mechanism generally designated 28.

Figure 8:
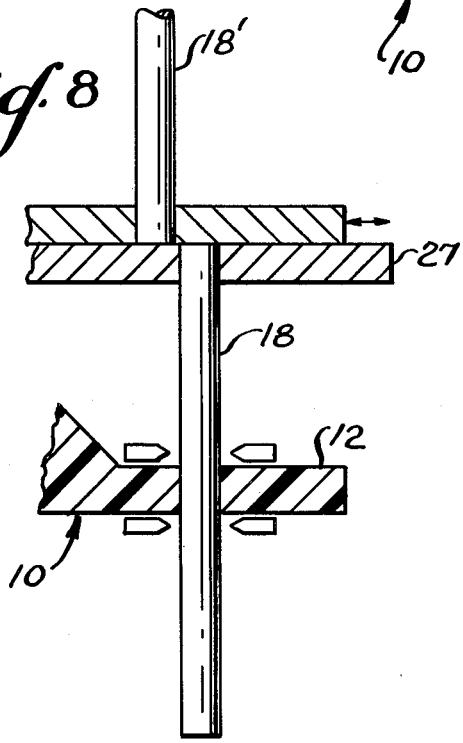
FIGS. 8 and 9 are views similar to FIG. 7 but showing the apparatus in subsequent stages of operation.
Figure 9:
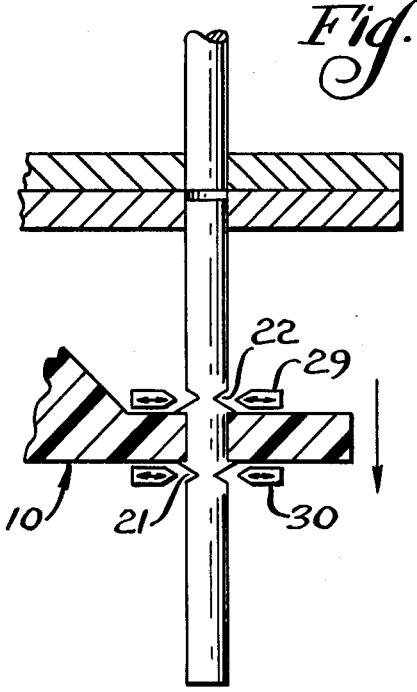

Once the arrangements of parts shown in FIG. 7 is achieved, the plates 26 and 27 are moved relative to each other as indicated in FIG. 8 to provide a cut-off of the wire 18′ and thereby develop the wire terminal 18. Thereafter, the notching jaws 29 and 30 are energized to provide the notches at 22 and 21, respectively—afterwhich the now integrated wire terminal-form can be removed for the subsequent operations depicted in FIGS. 3 and 4.

Whether cut-off occurs before or after notching is principally a matter of choice. In any event, the maintenance of the upper end of the wire terminal 18 within the stationary plate 27 (see FIG. 8) provides an advantageous stabilization for the wire terminal so as to resist any deformation incident to the notching whereby the notches are provided advantageously close to the flange 12 as well as avoiding any possibility of distorting the opening or passage 17.

Through the use of a cut-off mechanism embodying a stationary plate 17, I not only achieve the intended severance of the wire 18′ so as to develop the wire terminal 18 but at the same time provide an anchor or stabilizing support for the wire during the notching operation.

While in the foregoing specification a detailed description of the invention has been set down for the purpose of illustration, many variations in the details hereingiven may be made by those skilled in the art without departing from the spirit and scope of the invention.

I claim:

1. A method for making an inductance comprising providing a coil form constructed of insulating material and having at least one passage extending therethrough for the receipt of a wire terminal, positioning a terminal-providing wire in said passage with portions of the lead extending beyond the ends of said passage on both sides of the passage, said wire being continuous and of indefinite length, supporting said wire a spaced distance from one of said passage ends, notching the supported wire in portions adjacent said form to immobilize said wire relative to said form, severing the supported wire to provide said terminal prior to removal of the support;

removing the support from said wire wherebya terminal-equipped coil form is provided; and winding another wire onto said coil form to provide an inductance.

2. The method of claim 1 in which said form is molded, thermosetting plastic.

3. The method of claim 2 in which said form has a central cylindrical part and an end flange, said passage being in said flange.

4. The method of claim 1 in which said support includes a cutoff mechanism having a pair of plates slidably related relative to each other and having aligned openings therein, said wire being positioned within said openings and severed by relative movement of said plates.

5. The method of claim 4 in which said notching is performed prior to said severance.

6. The method of claim 4 in which said notching is performed subsequent to said severance.

* * * * *